United States Patent [19]

Masuda et al.

[11] Patent Number: 4,938,049

[45] Date of Patent: Jul. 3, 1990

[54] WARM ROLLING METHOD FOR HIGH SILICON STEEL STRIPS

[75] Inventors: Sadakazu Masuda; Fumio Fujita; Tadayoshi Murakami; Masahiko Yoshino; Ryuichi Yagi; Masamoto Kamata, all of Tokyo, Japan

[73] Assignee: Nippon Kokan Kabushiki Kaisha, Tokyo, Japan

[21] Appl. No.: 295,040

[22] PCT Filed: May 23, 1988

[86] PCT No.: PCT/JP88/00490

§ 371 Date: Dec. 20, 1988

§ 102(e) Date: Dec. 20, 1988

[87] PCT Pub. No.: WO89/11349

PCT Pub. Date: Nov. 30, 1989

[51] Int. Cl.[5] ..... B21B 1/22; B21B 1/32; B21B 3/00

[52] U.S. Cl. ..... 72/202; 72/700

[58] Field of Search ..... 72/148, 199, 200, 202, 72/365, 700, 229, 231, 234; 148/12 A, 111

[56] References Cited

U.S. PATENT DOCUMENTS

| | | | |
|---|---|---|---|
| 1,081,370 | 12/1913 | Cunningham | 148/111 |
| 1,965,559 | 7/1934 | Goss | 148/111 |
| 1,992,039 | 2/1935 | Reinhardt | 72/202 X |
| 3,009,176 | 7/1963 | Hall et al. | 72/700 X |
| 3,606,778 | 9/1971 | Bomberger | 72/202 X |
| 4,291,558 | 9/1981 | Santoli et al. | 72/202 X |
| 4,430,874 | 2/1984 | Tippins et al. | 72/202 |

FOREIGN PATENT DOCUMENTS

| | | | |
|---|---|---|---|
| 55-62124 | 5/1980 | Japan | 72/202 |
| 59-191502 | 10/1984 | Japan | 72/202 |

*Primary Examiner*—E. Michael Combs
*Attorney, Agent, or Firm*—Henry C. Nields

[57] ABSTRACT

The present invention relates to a warm rolling method for high Si steel strips, in which the steel strip is connected at both ends with leader strips which are excellent in cold or warm workability, and the ends of the leader strips are connected to tension reels for undertaking warm rolling on the steel strip. Whereby the leader strips are passed through rolls, the rolls can be preheated, and further whereby the both tension reels are disposed within warming furnaces and at least one of the leader strips is made longer than a distance between the tension reels, recovery treatment between passes can be carried out on the steel strip in the full length.

19 Claims, 2 Drawing Sheets

WARM ROLLING METHOD FOR HIGH SILICON STEEL STRIPS

TECHNICAL FIELD

This invention relates to a warm rolling method for high silicon steel strips.

BACKGROUND OF THE INVENTION

Recently, from standpoint of saving natural sources and energy, small sizes and high efficiency of electromagnetic or electronic parts have been demanded, and soft magnetic property, especially Si steel sheets having excellent iron loss have been also required. It is known that soft magnetic properties of Si steel sheets are improved with increasing of addition of Si and exhibit the maximum permeability at about 6.5 wt%, and since natural electric resistance is high, the iron loss is made small. In this kind of steel sheets, if the Si content is 4.0 wt% or more, workability is abruptly worsened, and therefore it has been impossible to produce high Si steel sheets in industrial scales by the rolling process, but it has been found that the warm rolling could be performed on the thin steel sheets.

However, the warm rolling is restricted as that the high Si steel sheet is poor in bending processing and could not be welded at room temperatures. When the high Si steel sheet is going to warm-roll (200° to 600° C.) and if the rolls are cool, the steel strip passing therebetween is chilled and invites cracks by working. Therefore the rolls should be preheated.

It was found through the inventors' investigations that the high Si steel strip could be rolled efficiently with by reversings, and warming between each passes of the reverse rollings by means of the tension reels disposed within the warming furnaces, and further magnetic property could be satisfied therein by the recovery treatment between passes in the warming furnaces. In the rolling, the steel strip should be coiled completely on one of the tension reels in each step of the reverse rollings.

DISCLOSURE OF THE INVENTION

The invention has been developed in view of such problems, and each end of the steel strip is connected with a leader strip of materials which have excellent cold and excellent warm workability. The ends of the leader strips are connected to tension reels for performing warm rolling on the steel strip.

According to the invention, because the leader strip has good workability, it can be exactly secured to the tension reel.

The leader strips can be used for preheating the rolls to prevent the strip from escaping of the temperature therefrom, which would happen by contacting cool rolls. The leader strips are heated and passed through the rolls, so that the rolls are preheated, and subsequently the steel strip is warm-rolled.

The steel strip is rolled by the warm reversings by means of the tension reels within the warming furnaces. For carrying out the recovery treatment on the steel strip by warming it between each passes of the reverse rollings, the lengthes of the leader strips are made larger than the distance between the tension reels. Thereby, the steel strip can be coiled completely on the tension reel after having finished the passes, so that the recovery may be effected on the steel strip in the full length.

MOST PREFERRED EMBODIMENT FOR PRACTISING THE INVENTION

Figure 1:
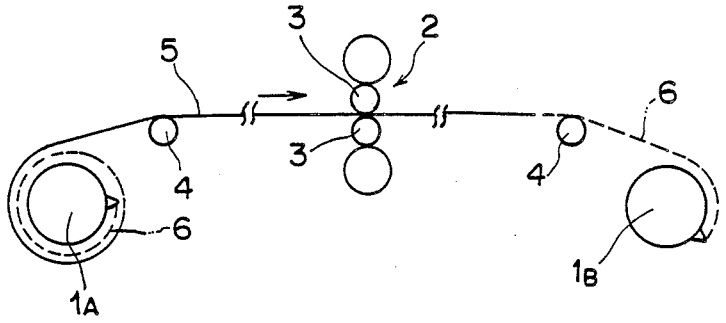
FIG. 1 shows schematically one embodiment of the invention.

In FIG. 1, 1A,1B are tension reels, 2 is a rolling machine, 3 is rolls, 4 represents deflectors, 5 represents a high Si steel strip (hereinafter referred to as "steel strip").

Each end of the steel strip 5 is connected with a leader strip 6 comprising materials (steel, iron or alloys) suitable for cold or warm working, such as SUS or SS. The leader strip should have the same thickness as the steel strip 5, and one end of each leader strip is secured to one of the tension reels 1A, 1B at ends by tightening bolts.

The leader strips 6 can be used for preheating the rolls 3. The leader strips 6 are heated together with the steel strip 5 and passed between the rolls 3 so that the leader strips 6 preheat the rolls 3 and subsequently the steel strip 5 is rolled. It is sufficient that the leader strip 6 so contacts the rolls 3 as to secure the heat conductivity of the leader strip 6 to the rolls 3, and enough contacting may be achieved by the pressing caused by the roll's own weight. For preheating the rolls 3 by the leader strip 6, the leader strip 6 should be long enough to preheat the rolls 3, and normally at least one of the leader strips has such a length.

Figure 2:
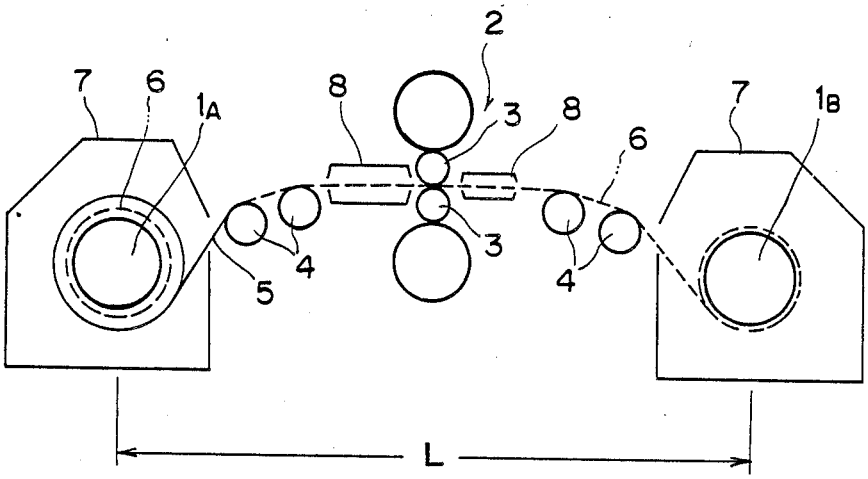
FIG. 2 shows the practice of the invention more concretely.

FIG. 2 shows so-called reverse rolling on the steel strip, and each tension reel 1A,1B is disposed within a warming furnace 7 having heating means such as burners. Additional heating means 8 are installed at the inlet and the outlet of the rolling machine 2 for heating the steel strip.

The steel strip 5 is warmed to a predetermined temperature in the warming furnaces 7, and reversely warm-rolled between the tension reels 1A and 1B, while being heated at the inlet and the outlet of the rolling machine 2, and the recovery treatment is carried out by warming the steel strip between passes of the reverse rollings.

When depending upon this rolling system, the lengths of each leader strip 6 to be connected to the steel strip 5 is made longer than the distance L between the tension reels 1A and 1B, so that after each pass of the reverse rollings is finished, the steel strip 5 is coiled to its full length on a tension reel 1A or 1B, and the recovery treatment between passes is done within the warming furnaces 7.

Also, in this rolling, the leader strip 6 can be used for preheating the rolls 3, in which event one of the leader strips 6 should be longer than the distance L between the tension reels 1, and the length should be enough to preheat the rolls. However, the rolls 3 are sometimes installed with independent heating means, and then the length of the leader strip 6 may be determined in reference to the above distance L.

The steel strip 5 and the leader strip 6 cannot be welded directly, and one must depend upon tightening means as rivets, bolts or the like. Connecting parts of this nature cannot pass through the rolls, and when the rolling comes nearly to the connecting parts, the rolls are lifted to pass the connecting parts and the rolling is continued.

Figure 4:
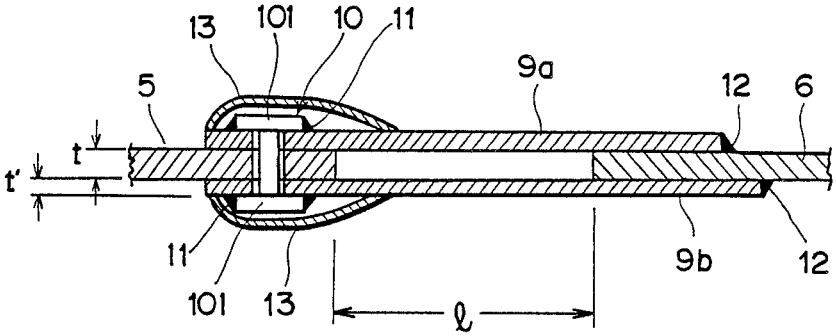
FIGS. 3 and 4 show connections of the steel strip and the leader strip.
Figure 3:
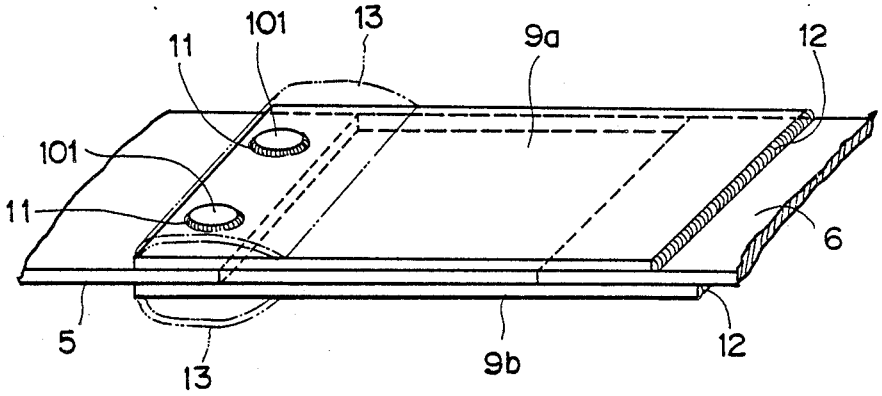

FIGS. 3 and 4 show examples of preferable connections of the steel strip 5 and the leader strip 6. If the strips 5 and 6 were welded directly, the Si steel material would become brittle owing to the effect of heat and thus invite breakages. Therefore, the present practices employ the aforementioned securing means and a connecting plate. One end of each of two weldable connecting plates *9a,9b* are placed on a surface of the steel strip 5, and connected thereto by securing members 10 (bolts, rivets, pins or others) through holes formed therein, and heads 101 of the members 10 which are positioned against the plates *9a,9b* are connected to the plates 9 by weldments 11. The other ends of the plates *9a,9b* are placed on the surfaces of the leader strip 6 and fixed thereto with weldments 12. SUS materials may be used for the connecting plate 9 as well as for the leader strip 6. Further, cover plates 13 protect the heads of the members 10 and avoid the making of local bendings when the strip is coiled, and projections of the members 10 contact the steel strip 5 coiled outside of the memebrs 10. The cover plate 13 is also made of SUS material and welded to the connecting plates 9.

If the connecting plates *9a,9b* are large in thickness, local bending may occur in the steel strip. It is preferable that the thickness of the connecting plate 9 is the same as or less than that of the steel strip 5, though it depends upon the material quality. Especially, with respect to the connecting plate *9b* to be an inner side of the coil, the thickness of the connecting plate 9 should be less than a thickness t' of the steel strip (e.g., t/2).

A length l between the end of the leader strip and the end of the steel strip should be ½ to 1/1 of the diameter of the deflector roll. If l were too short, the steel strip would not follow an arc of the deflector roll, and the steel strip 5 would be given extreme force at the connecting parts due to tension force of the leader strip and call breakage. The connecting plates *9a* and *9b* should be different in length so as to disperse thermal stress at welding the leader strip 6.

In the invention, since the leader strip has good workability, it may be exactly applied to a high Si steel sheet. The rolls are preheated by the leader strips, so that the steel sheet may prevent from escaping of the temperature therefrom, and cracks at rolling may be avoided. When the steel strip is subjected to the reverse rolling and carried out with the recovery treatment between passes in the warming furnaces incorporated with the tension reels and if the length of the leader strip is larger than the distance between the tension reels, the steel strip may be coiled and carried out with the recovery treatment in the full length and it is possible to produce the high Si steel sheets having excellent magnetic property at high productvity.

INDUSTRIAL APPLICABILITY

This invention may be applied preferably to the warm rolling of high silicon steel bands containing more than 4.0 wt% Si.

What is claimed is:

1. A warm rolling method for a high Si steel strip having a first end and a second end, comprising connecting a first leader strip to said first end and a second leader strip to said second end, said leader strips having excellent cold workability and excellent warm workability, connecting the free end of said first leader strip to a first tension reel, connecting the free end of said second leader strip to a second tension reel, and warm rolling on the steel strip by means of reducing rolls, said warm rolling method including the steps of rotating said tension reels to draw the strip through said reducing rolls to warm roll the strip.

2. The method as claimed in claim 1, comprising passing heated leader strips through rolls to preheat the latters, and subsequently performing the warm rolling on the Si steel strip.

3. The method as claimed in claim 1, comprising preheating the rolls by heating the rolls by means of heating means installed to the rolls and by passing the heated leader strips through the rolls, and subsequently performing the warm rolling on the steel strip.

4. A warm rolling method for a high Si steel strip having a first end and a second end by means of a first tension reel within a first warming furnace having heating means and a second tension reel within a second warming furnace, comprising connecting a first leader strip to said first end and a second leader strip to said second end, said leader strips having excellent cold workability and excellent warm workability, the length of at least one of the leader strips being larger than the distance between the tension reels, connecting the free end of said first leader strip to said first tension reel, connecting the free end of said second leader strip to said second tension reel, carrying out warm reverse rolling on the steel strip by a sequence of passes in which the steel strip is uncoiled from one tension reel while being coiled on the other tension reel, and coiling the full length of the steel strip on the tension reel between at least some of said passes whereby recovery treatment may be performed between passes by means of said warming furnaces.

5. The method as claimed in claim 4, comprising passing heated leader strips through rolls to preheat the latters, and subsequently performing the warm rolling on the Si steel strip.

6. The method as claimed in claim 4, comprising preheating the rolls by heating the rolls by means of heating means installed to the rolls and by passing the heated leader strips through the rolls, and subsequently performing the warm rolling on the steel strip.

7. A warm rolling method for high Si steel strips by means of a first tension reel within a first warming furnace having heating means and a second tension reel within a second warming furnace, comprising connecting a first leader strip to said first end and a second leader strip to said second end, said leader strips having excellent cold workability and excellent warm workability, the lengths of the leader strips being larger than the distance between the tension reels, connecting the free end of said first leader strip to said first tension reel, connecting the free end of said second leader strip to said second tension reel, carrying out warm reverse rolling on the steel strip by a sequence of passes in which the steel strip is uncoiled from one tension reel while being coiled on the other tension reel, and coiling the full length of the steel strip on the tension reel between at least some of said passes whereby recovery treatment may be performed between passes by means of said warming furnaces.

8. The method as claimed in claim 7, comprising passing heated leader strips through rolls to preheat the latters, and subsequently performing the warm rolling on the Si steel strip.

9. The method as claimed in claim 7, comprising preheating the rolls by heating the rolls by means of heating means installed to the rolls and by passing the heated leader strips through the rolls, and performing the warm rolling on the steel strip.

10. A warm rolling method for a high Si steel strip having a first end and a second end, comprising connecting a first leader strip to said first end by means of a securing member by positioning one end of a weldable connecting plate on the steel strip and welding the other end to the leader strip and a second leader strip to said second end by means of a securing member by positioning one end of a weldable connecting plate on the steel strip and welding the other end to the leader strip, said leader strips having excellent cold workability and excellent warm workability, connecting the free end of said first leader strip to a first tension reel, connecting the free end of said second leader strip to a second tension reel, and warm rolling on the high Si steel strip by means of reducing rolls, said warm rolling method including the steps of rotating said tension reels to draw the strip through said reducing rolls to warm roll the strip.

11. The method as claimed in claim 10, comprising passing heated leader strips through rolls to preheat the latters, and subsequently performing the warm rolling on the Si steel strip.

12. The method as claimed in claim 10, comprising preheating the rolls by heating the rolls by means of heating means installed to the rolls and by passing the heated leader strips through the rolls, and subsequently performing the warm rolling on the steel strip.

13. A warm rolling method for a high Si steel strip by means of a first tension reel within a first warming furnace having heating means and a second tension reel within a second warming furnace, comprising connecting a first leader strip to said first end by means of a securing member by positioning one end of a weldable connecting plate on the steel strip and welding the other end to the leader strip, and a second leader strip to said second end by means of a securing member by positioning one end of a weldable connecting plate on the steel strip and welding the other end to the leader strip, said leader strips having excellent cold workability and excellent warm workability, the length of at least one of the leader strips being larger than the distance between the tension reels, connecting the free end of said first leader strip to a first tension reel, and connecting the free end of said second leader strip to a second tension reel, carrying out warm reverse rolling on the steel strip by a sequence of passes in which the steel strip is uncoiled from one tension reel while being coiled on the other tension reel, and coiling the full length of the steel strip on the tension reel between at least some of said passes whereby recovery treatment may be performed between passes by means of said warming furnaces.

14. The method as claimed in claim 13, comprising passing heated leader strips through rolls to preheat the latters, and subsequently performing the warm rolling on the steel strip.

15. The method as claimed in claim 13, comprising preheating the rolls by heating the rolls by means of heating means installed to the rolls and by passing the heated leader strips through the rolls, and subsequently performing the warm rolling on the steel strip.

16. A warm rolling method for a high Si steel strip having a first end and a second end by means of a first tension reel within a first warming furnace having heating means and a second tension reel within a second warming furnace, comprising connecting a first leader strip to said first end by means of a securing member by positioning one end of a weldable connecting plate on the steel strip and welding the other end to the leader strip, and a second leader strip to said second end by means of a securing member by positioning one end of a weldable connecting plate on the steel strip and welding the other end to the leader strip, said leader strips having excellent cold workability and excellent warm workability, the lengths of each of the leader strips being larger than the distance between the tension reels, connecting the free end of said first leader strip to a first tension reel, and connecting the free end of said second leader strip to a second tension reel, carrying out warm reverse rolling on the steel strip by a sequence of passes in which the steel strip is uncoiled from one tension reel while being coiled on the other tension reel, and coiling the full length of the steel strip on the tension reel between at least some of said passes whereby recovery treatment may be performed between passes by means of said warming furnaces.

17. The method as claimed in claim 16, comprising passing heated leader strips through rolls to preheat the latters, and subsequently performing the warm rolling on the steel strip.

18. The method as claimed in claim 16, comprising preheating the rolls by heating the rolls by means of heating means installed to the rolls and by passing the heated leader strips through the rolls, and subsequently performing the warm rolling on the steel strip.

19. The method as claimed in claim 1 to 17 or 18, comprising using stainless steel strips or ordinary steel strips as the leader strips.

* * * * *